US010143912B2

(12) United States Patent
Gonzalez

(10) Patent No.: US 10,143,912 B2
(45) Date of Patent: Dec. 4, 2018

(54) LOTTERY GAME SYSTEM, PRODUCT AND METHOD WITH ENCRYPTED PLANAR DISPLAYS

(71) Applicant: IGT GLOBAL SOLUTIONS CORPORATION, Providence, RI (US)

(72) Inventor: Humberto Olmos Gonzalez, Mexico City (MX)

(73) Assignee: IGT Global Solutions Corporation, Providence, RI (US)

( * ) Notice: Subject to any disclaimer, the term of this patent is extended or adjusted under 35 U.S.C. 154(b) by 171 days.

(21) Appl. No.: 15/125,235

(22) PCT Filed: Mar. 25, 2016

(86) PCT No.: PCT/US2016/024184
§ 371 (c)(1),
(2) Date: Sep. 12, 2016

(87) PCT Pub. No.: WO2016/160557
PCT Pub. Date: Oct. 6, 2016

(65) Prior Publication Data

US 2018/0169514 A1 Jun. 21, 2018

Related U.S. Application Data

(60) Provisional application No. 62/139,270, filed on Mar. 27, 2015.

(51) Int. Cl.

| | |
|---|---|
| ***A63F 1/06*** | (2006.01) |
| ***A63F 3/06*** | (2006.01) |
| ***A63F 3/00*** | (2006.01) |
| ***G07C 15/00*** | (2006.01) |
| ***B42D 25/27*** | (2014.01) |
| *G07F 17/32* | (2006.01) |

(52) U.S. Cl.
CPC ..... *A63F 3/065* (2013.01); *A63F 3/00* (2013.01); *A63F 3/06* (2013.01); *A63F 3/0655* (2013.01); *A63F 3/0665* (2013.01); *A63F 3/0685* (2013.01); *B42D 25/27* (2014.10); *G07C 15/00* (2013.01); *G07C 15/005* (2013.01); *G07F 17/329* (2013.01); *G07F 17/32* (2013.01)

(58) Field of Classification Search
CPC ..... A63B 71/00
USPC ..... 273/138.1
See application file for complete search history.

(56) References Cited

U.S. PATENT DOCUMENTS 1,833,869 A * 11/1931 Cotton ..... B42D 25/29 283/106
3,316,531 A * 4/1967 Baker ..... B63B 22/06 337/150

(Continued)

OTHER PUBLICATIONS

International Search Report and Written Opinion (ISR/WO), PCT/US16/24184, US International Search Authority, dated Jul. 12, 2016.

*Primary Examiner* — John E Simms, Jr.
*Assistant Examiner* — Dolores Collins
(74) *Attorney, Agent, or Firm* — Williams Mullen; Thomas F. Bergert

(57) ABSTRACT

A lottery system, ticket product and method incorporate a lottery ticket product having encrypted planar displays, wherein results are revealed through malforming the ticket, such as by manipulating the ticket to decrypt information contained on the ticket.

15 Claims, 3 Drawing Sheets

(56) References Cited

U.S. PATENT DOCUMENTS 4,882,473 A * 11/1989 Bergeron ..... G06Q 20/341 235/375
5,769,716 A * 6/1998 Saffari ..... G07F 17/3265 273/143 R
5,871,398 A * 2/1999 Schneier ..... G07F 17/3218 463/16
5,931,468 A * 8/1999 Orolin ..... A63F 3/069 273/139
5,996,997 A * 12/1999 Kamille ..... A63F 3/065 273/138.1
6,000,725 A * 12/1999 Nicolosi ..... A63F 3/065 235/487
6,056,289 A * 5/2000 Clapper, Jr. ..... G06Q 20/342 273/138.2
6,523,826 B1 * 2/2003 Matos ..... A63F 9/0613 273/155
6,676,126 B1 * 1/2004 Walker ..... A63F 3/0665 273/139
6,887,153 B2 * 5/2005 Walker ..... G06Q 10/087 273/269
7,008,318 B2 * 3/2006 Schneier ..... A63F 3/081 463/17
9,818,261 B2 * 11/2017 Pacey ..... G07F 17/3258
2004/0056416 A1 * 3/2004 Bennett, III ..... G07C 15/00 273/269
2005/0233797 A1 * 10/2005 Gilmore ..... G06Q 20/202 463/17
2005/0255905 A1 * 11/2005 Duke ..... A63F 3/0605 463/17
2006/0258433 A1 * 11/2006 Finocchio ..... A63F 3/062 463/16
2006/0279038 A1 * 12/2006 Irwin, Jr. ..... A63F 3/0665 273/138.1
2009/0121425 A1 * 5/2009 Berkowitz ..... A63F 3/0665 273/139
2011/0248444 A1 * 10/2011 Schlachtenhaufen ... A63F 9/088 273/157 R
2011/0281630 A1 * 11/2011 Omar ..... G06F 21/33 463/17
2012/0228861 A1 * 9/2012 Friesen ..... A63F 3/0665 283/101

* cited by examiner 15
15
58
External Systems
Local System
40
Network
75
100
50
49
Vending Device Management Component
Player Management Component
56
52
Game Management Component
Financial Management Component
58
Loyalty Component
Communications Component
60
54
Management Component
Randomizer Component
77
62
Accounts Database
71
Loyalty Database
73
74
70
Games Database
72
Display Database
Management Database

LOTTERY GAME SYSTEM, PRODUCT AND METHOD WITH ENCRYPTED PLANAR DISPLAYS

TECHNICAL FIELD

The present invention relates to lottery game systems, products and methods, and more particularly to a lottery system with specially designed lottery ticket product and method where planar displays are encrypted and results are revealed through malforming the ticket.

BACKGROUND ART

Traditional lottery game systems issue instant lottery tickets where a game is displayed on a first planar surface thereof. In order to assess whether the ticket is a winner, players can scratch off a removable coating on the first planar surface of the ticket to reveal player indicia results. The player indicia results can be compared to game indicia results on the first planar surface to determine whether the ticket is a winner and the value of the winnings. The player indicia and game indicia are not encrypted or incomplete in any aspect, and the player has all of the information necessary on the first planar surface to assess whether the ticket is a winner. The second planar surface, or back side, of the ticket can include game play information and redemption instructions, for example. One or more codes can be applied to the first planar surface and/or the second planar surface of the ticket for validation purposes, as will be understood in the art.

DISCLOSURE OF INVENTION

Embodiments of the present invention relate generally to lottery systems, ticket products and methods, including a lottery ticket product having encrypted planar displays, wherein results are revealed through malforming the ticket, such as by manipulating the ticket a certain way to decrypt information contained on the ticket.

According to various embodiments, the present invention can be provided as the sole winning ticket determination mechanism, or as one of multiple ways to win on a ticket, including as a bonus mechanism. In various embodiments, the bonus feature is not identified as a winner or non-winner until the ticket is turned and a corresponding bonus symbolization on the back of the ticket matches or completes the symbolization on the front.

Among other elements, embodiments of the present invention provide a lottery ticket product and method of playing a lottery game in which the winning status of the ticket cannot be determined by simply viewing one planar face of the ticket. Instead, a player must twist, bend and/or otherwise physically or electronically malform or manipulate the ticket to match a symbolization (or portion thereof) on the back planar surface of the ticket with another symbolization (or portion thereof) on the front planar surface of the ticket.

In general, a lottery ticket comprises front and back planar surfaces, each of which has an upper edge, a lower edge, and left and right side edges. The ticket need not necessarily be rectangular to include such surfaces and edges. According to various embodiments, a first area located adjacent one of the side edges on the front planar surface can be provided with a first gaming symbolization disposed thereon that forms a first portion of a prize symbol or other game symbolization. A second area located adjacent the upper edge on the back planar surface can be provided with a second gaming symbolization disposed thereon that forms a second portion of a prize symbol or other game symbolization. The arrangement is such that, upon twisting the ticket and positioning the second gaming symbolization adjacent the first gaming symbolization, the winning status of the lottery ticket or an aspect of the lottery ticket is determined. For example, if the symbolization on the first planar surface identifies a first portion of a phrase, word (e.g., "WI" of the word "WIN") and/or design (e.g., a portion of a turtle), and the symbolization on the second planar surface identifies a second portion of a phrase, word and/or design that completes the phrase, word and/or design when paired with the first symbolization, then the completed prize symbolization indicates that the player is a winner. As an alternative, a player can win by matching symbolizations on the first planar surface with symbolizations on the second planar surface.

In another aspect of the present invention, a method of playing a lottery game with a ticket comprises the steps of: (a) twisting the ticket such that a first gaming symbolization on the back planar surface is positioned adjacent a second gaming symbolization on the front planar surface; and (b) positioning the second gaming symbolization adjacent the first gaming symbolization. The lottery ticket is a winning ticket if the combined symbolizations spell a phrase or word (e.g., "WIN") and/or complete a design (e.g., a turtle).

Other objects, features and advantages of the invention shall become apparent as the description thereof proceeds when considered in connection with the accompanying illustrative drawings.

MODES FOR CARRYING OUT THE INVENTION

Figure 1:
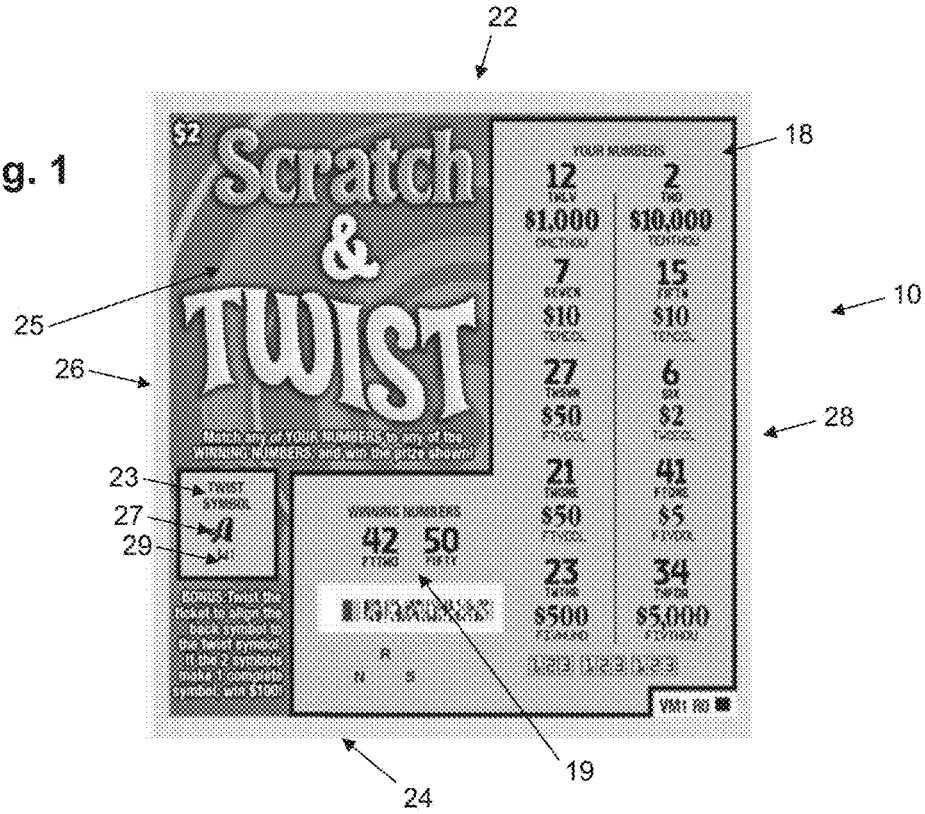
FIG. 1 is a front elevational view of a front planar surface of a lottery ticket product of the present invention.
Figure 2:
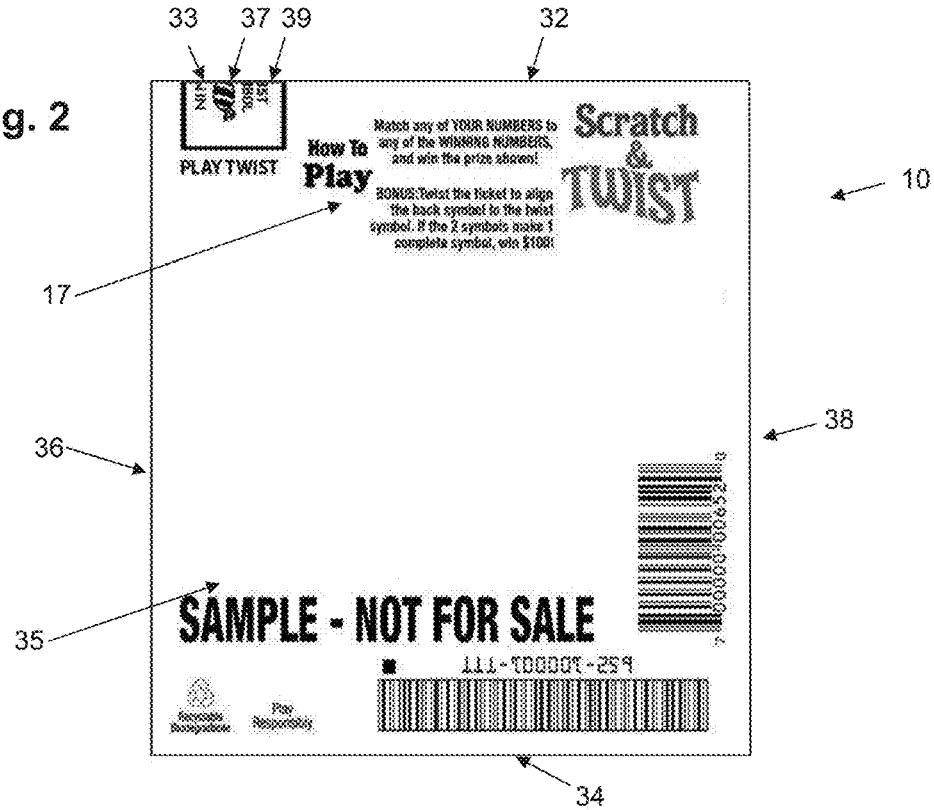
FIG. 2 is a rear elevational view of a back planar surface of the lottery ticket product depicted in FIG. 1.
Figure 3:
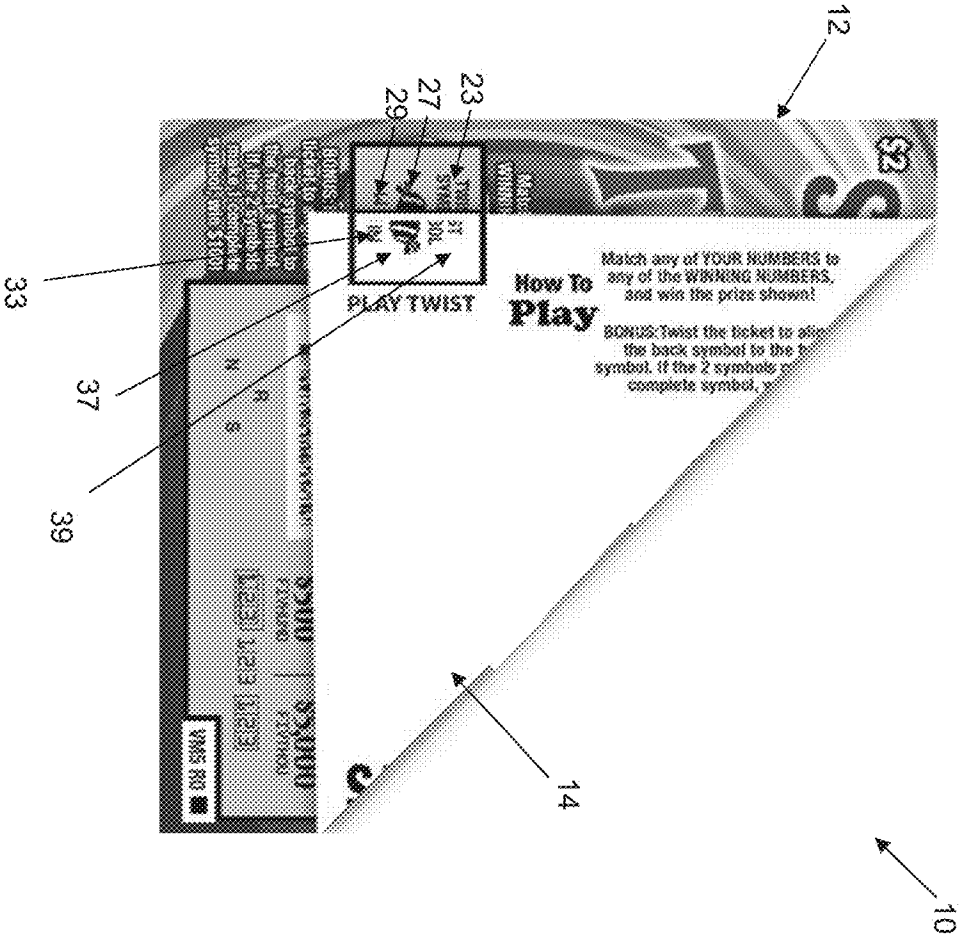
FIG. 3 is a front perspective view of the lottery ticket product depicted in FIGS. 1 and 2 being manipulated for decryption.

As shown in FIGS. 1 through 3, a lottery ticket product 10 is shown. The lottery ticket product 10 can be fabricated from paper stock material that is relatively light in weight, in various embodiments of the present invention. Preferably, the lottery ticket product 10 can be produced locally by a lottery terminal (e.g., 15 in FIG. 4) that is in communication with a central processing station (e.g., 49 in FIG. 4). It should also be understood that the lottery ticket product 10 according to various embodiments of the present invention can be fabricated from any material that is capable of having data applied or printed thereon, and is resilient in nature so that the player can easily manipulate the lottery ticket in a manner such as described below.

As shown in FIGS. 1 through 3, the lottery ticket product 10 has a substantially rectangular-shaped body with front 12 and back 14 planar surfaces. It will be appreciated that the ticket can be provided in different geometrical shapes and sizes in various other embodiments of the invention. The front planar surface 12 has an upper edge 22, a lower edge 24, a left-hand edge 26 and a right-hand edge 28. The back planar surface 14 has an upper edge 32, a lower edge 34, a left-hand edge 36 and a right-hand edge 38. The respective surfaces 25, 35 of the front 12 and back 14 planar surfaces of the lottery ticket 10 include a plurality of areas having printed or applied material, such as the name of the lottery game, bar code information, time and date information, etc. Such information can be used for validation purposes, for example. It will be appreciated that the term "printed" need not necessarily include the use of inks, but can include the application of heat to thermal ticket stock in order to activate thermally sensitive coatings that display desired content upon being heated.

In the embodiment shown in FIG. 1, the surface 25 of the front face 12 near the left hand edge 24 includes a first gaming symbolization (or set of gaming symbols) 23, 27 and/or 29, and this symbolization can be printed thereon such as by employing a printing process, for example. As shown in FIG. 1, symbolization 23 includes the left portion of the words "TWIST SYMBOL", symbolization 27 is the left half of a design symbol, and symbolization 29 is the left portion of the word "WIN". The first gaming symbolization can be any of the symbolizations 23, 27 and 29 individually, or any combination thereof. These symbolizations can be considered as encrypted because they do not provide a completed and recognizable symbol, such as a word, phrase or graphic design.

In the embodiment shown in FIG. 2, the surface 35 of the back face 14 near the upper edge 32 includes a second gaming symbolization (or set of gaming symbols) 33, 37 and/or 39, and this symbolization can be printed thereon such as by employing a printing process, for example. Symbolizations 33, 37 and 39 are oriented differently from other content 17 on surface 35. For instance, symbolizations 33, 37 and 39 are oriented in a ninety degree rotation from the instruction wording 17. Further, if one were to view the front surface 25 of the ticket 10 and view symbolizations 23, 27 and 29 in their proper, left-to-right horizontal orientation for reading, and then one were to flip the ticket 10 around to view the back surface 35 while keeping the symbolizations 23, 27 and 29 oriented horizontally, the symbolizations 33, 37 and 39 would not be oriented left-to-right horizontally, but would rather be oriented from top-to-bottom, vertically. As a result, when the ticket is manipulated as described elsewhere herein, the symbolizations 33, 37 and 39 will rotate orientation so as to have a consistent orientation with symbolizations 23, 27 and 29 on the front surface 25. Such rotation facilitates a fast, visually constructive reading to assess whether a match or a fully formed symbolization has occurred.

As shown in FIG. 1, symbolization 33 is the right portion of the word "WIN", symbolization 27 is the right half or side of a design symbol, and symbolization 39 are the right portion of the words "TWIST SYMBOL". The second gaming symbolization can be any of the symbolizations 33, 37 and 39 individually, or any combination thereof. The full phrase "TWIST SYMBOL", the full design symbol and full word "WIN" are thus encrypted and only provided on each planar surface in incomplete form. Thus, the ticket product of FIGS. 1 through 3 is not capable of having a single planar surface 12, 14 read in order to assess whether the ticket is a winner of the game represented on both surfaces.

As shown in FIG. 3, when the ticket is physically manipulated such as by twisting the back planar surface 14 of the ticket over top of the front planar surface 12, the upper edge 32 of the back surface 14 can be folded and twisted so as to align the second gaming symbolization 33, 37 and/or 39 with the first gaming symbolization 23, 27 and/or 29 on the front surface 12. In so doing, the word "WIN" can be spelled out and the design element formed by the design portions 27, 37 can be fully formed in a winning ticket. It will be appreciated that a losing ticket would not result in a match or full formation of the word "WIN" and/or a match or full formation of the design portion, in various embodiments of the present invention. It will also be appreciated that the ticket can be a winner if a single element is fully formed, whether that element be a phrase such as "TWIST SYMBOL", a word such as "WIN" or a design such as the turtle design shown. Thus, it is not necessary that multiple elements be fully formed in order for the ticket to be a winner. In the embodiments of the present invention where matching results in a win, as opposed to forming a fully formed word, phrase or design, the symbolization on the first planar surface matches the symbolization on the second planar surface resulting in a pair of matched elements or symbolizations.

The matching symbolization 23, 33, 27, 37, 29, 39 can be the primary or sole game on the ticket 10, or can be a secondary or bonus game. As shown in FIG. 1, the primary game is a scratch-off instant ticket game whereby a player can win by matching any of "Your Numbers" as at 18 with the "Winning Numbers" as at 19. In this example, the matching of first and second gaming symbolizations as described above is a bonus game. Thus, it will be understood that the lottery ticket 10 of the present invention can provide a player with multiple opportunities to win on a single ticket, as with an instant ticket, but can be generated by a standard terminal since there are no special materials to be applied to the ticket. The player "plays" by aligning the first and second gaming symbolizations, whether the symbolizations include individual or multiple elements. This provides excitement to the game as the player cannot determine whether the bonus game has been won by merely viewing a single planar surface of the ticket.

Figure 4:
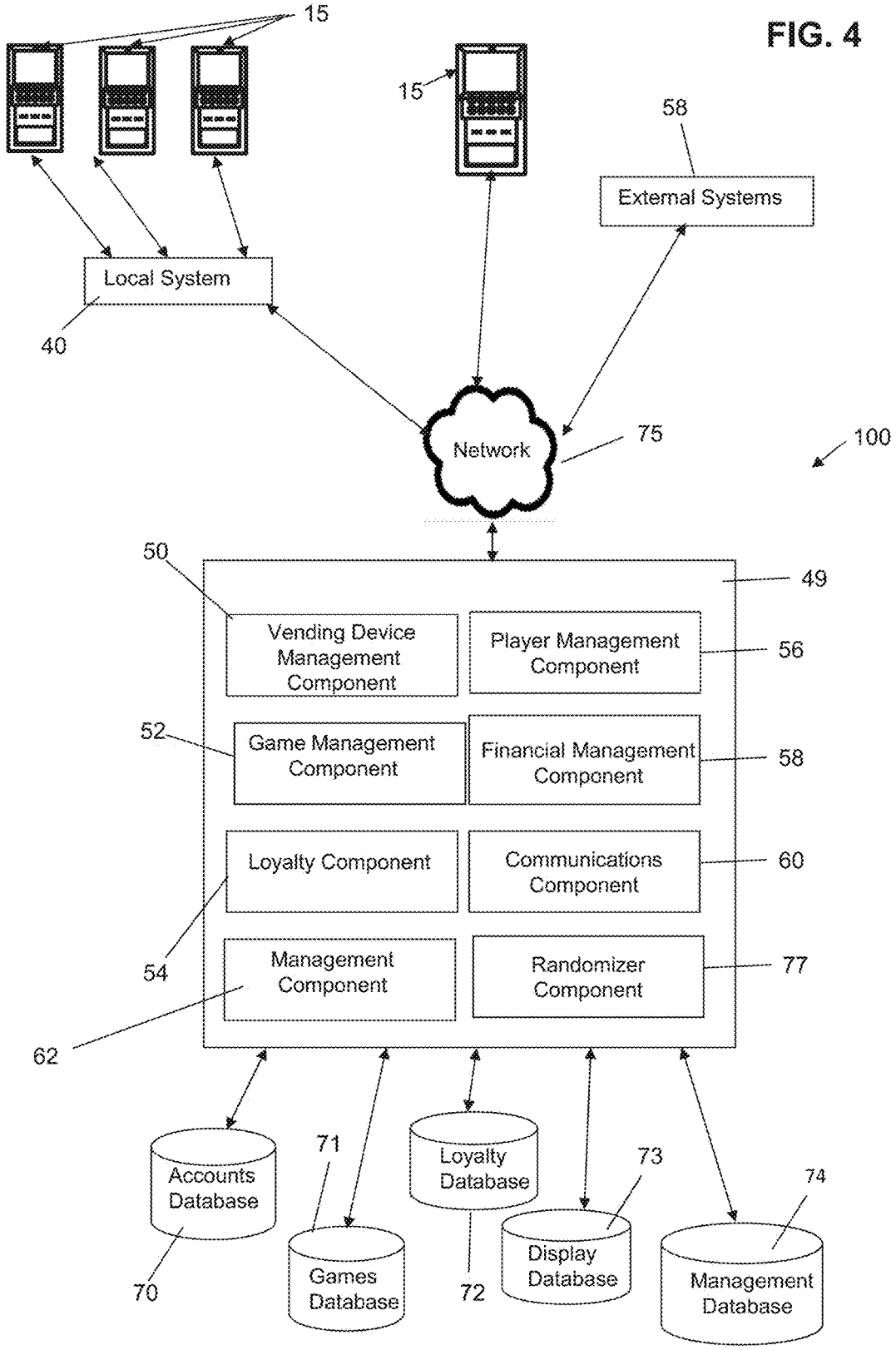
FIG. 4 is a schematic diagram illustrating a system interacting with vending and/or display devices in accordance with embodiments of the present invention.

According to various embodiments, the ticket products of the lottery game system and method according to the present invention can be printed physical tickets, or can also be electronic tickets that are played using any of various electronic devices, including mobile communications devices (e.g., smart phones), personal computing devices (e.g., desktops, laptops), stand-alone video lottery terminals, retailer terminals and other known devices, for example, as represented by 15 in FIG. 4. In one embodiment of the present invention, electronic tickets can be presented to the user of an electronic device over a network that is connected to a host computer that creates, issues, validates and/or redeems tickets using suitable programming stored in a memory thereof and operable via a computer processor maintained within the host. The player's electronic device also includes suitable programming, memory and processing capability to facilitate electronic representation of the game of the present invention on a display associated with the electronic device.

In another aspect of the present invention, a method of providing a lottery game system and product is provided. The method includes providing a ticket having potentially winnable prizes via first and second planar surfaces according to the various embodiments shown and described herein.

As noted above, the game system can employ physical ticket products, or virtual tickets accessible via a computing device, including mobile devices. A ticket can be obtained at a retail location from a clerk operating a point-of-sale device or from a self-service kiosk, for example. A ticket can also be obtained through a website, through a mobile application, and through other physical and virtual locations. Any device 15 operable to display, construct or print a ticket according to the present invention can be referred to as a vending device herein.

In various embodiments, the present invention can operate with one or more vending units 15 in networked connection with a remote central host computer system 49, as shown in FIG. 4 and described elsewhere herein. The central host computer system 49 can provide instructions to the one or more vending devices 15 as these devices carry out their designed functions. As shown in FIG. 4, it will be appreciated that system 10 can be deployed with direct connections from central host 49 to a vending device 15 via network 75, or through an indirect connection through a local computing system 40. As further shown in FIG. 4, the central host 49 can be provided with various components such as, for example, device management component 50, game management component 52, loyalty component 54, player management component 56, financial management component 58, communications component 60, general management component 62 and randomizer component 77. These components can access and employ various databases for storing and retrieving data in accordance with the desired functions of the present invention. Databases can include, for example, an accounts database 70, a game database 71, a loyalty database 72, a display database 73 and a management database 74.

The accounts database 70 can store information related to user accounts, including user identification details, user transaction history, user preferences, user financial information and account details and other information. The game database 71 can store information pertaining to available games for selection, including graphic designs, grids, words, relationship links for grids, available wager amounts, odds and other game-related elements. Loyalty database 72 can store various loyalty-related data, including redemption prizes, qualifying levels and other loyalty items. The display database 73 can store a library of displays (e.g., surfaces 12 and 14) to be presented on the device interfaces, including player selection options (for touch-screen selection or manipulation) as well as visual outcome displays or animations employed during inactive periods or for entertainment during player use. Management database 74 can store information such as device-specific statistics to permit lottery service providers and retailers to better understand device usage, including game-related statistics, ticket volumes, retailer statistics and other information that can assist in better servicing players, increasing revenue and overall management of devices.

The specific components can comprise software or hardware, incorporating computer-readable instructions stored in suitable memory and operable by one or more processors to perform the functions necessary for operation of the embodiments of the present invention. For instance, the device management component 50 operates to receive instructions from the vending devices 15, process the desired transactions and requests, and deliver instructions to the vending devices 15 for printing, displaying and/or otherwise executing the desired device functions. The game management component 52 operates to process specific game-related instructions such as, for example, selecting desired game details from the game database 71, configuring the details according to player requests and game rules, and delivering the details to the vending device 15 for printing, display and/or other operations. The loyalty component 54 operates to process loyalty-related transactions as appropriate based on player interaction, including adding to or subtracting from a loyalty points total, redeeming loyalty points and issuing prizes as appropriate. The player management component 56 processes user-related details, including user transaction requests, and updates the accounts database 70 accordingly. The financial management component 58 operates to process financial transactions initiated at the vending devices 15, including communicating with accounts database 70 and any other external providers 58, such as financial institutions, for example. The communications component 60 operates to communicate with the vending devices 15 and external providers 58 over network 75 to perform functions in accordance with the embodiments of the present invention. The management component 62 processes management-related information, such as usage statistics and control information, to and from management database 74. Such information can be employed by external systems 58 such as an external management operator, or by local systems, such as system 100, which can be a retailer operation controlling multiple devices 15 as shown in FIG. 4, for example. The randomizer component 77 operates to randomly select games and symbolizations from the games database 71 in order to populate game details and symbolizations to be represented on the multiple surfaces of each ticket product.

In various embodiments, the games database 71 can be initially populated with various ticket product constructions and relationship compatibility links, including at least a first set of ticket product constructions that have matching symbolizations and a second set of ticket product constructions that do not have matching symbolizations.

In operation, a user may be presented with a game selection display from which to choose a game in which to wager on for a wagering game associated with the present invention. The selection display may be presented, for example, on a display of the user's computing device 15, on a display of a self-service operated kiosk vending device 15, or on a display of a retailer-operated vending device 15, wherein the user selects the game by communicating with a sales clerk operating the device 15, for example. With reference to FIG. 4, and depending upon the implementation, a wager request may be received at a vending device 15 and then transferred to the central host 49. Payment can be handled at the device through via cash, bank card account and/or player account, for example. The wager request can further include the selection of a desired game, ticket design, wager level, prize structure or other selection. Once the payment and ticket/ticket selection have been received by the device 15, the player inputs are transmitted to the central host 49 for processing and storing, or a subset of player inputs are transmitted.

In response to a user selecting a specific game, for example, the host 49 operates randomizer component 77 to randomly select ticket indicia and symbolizations corresponding to the selected game.

It will be appreciated that, in various embodiments and using FIGS. 1 and 2 as an example, tickets are generated by (1) randomly generating the indicia and symbolization(s) for application to the first planar surface, including at least one primary encrypted (e.g., partially completed) symbolization associated with a game on the ticket; (2) randomly generating the symbolization on the second player surface, including at least one secondary encrypted symbolization associated with the game; and (3) applying the first planar surface symbolization to the first planar surface and the second planar surface symbolization to the second planar surface. In various embodiments, the at least one primary encrypted symbolization is applied along at least one side edge of the first planar surface of the ticket, and the at least one secondary encrypted symbolization is applied along one of the top edge or the bottom edge of the second planar surface of the ticket. When these steps are completed, a single ticket is created, and these steps are repeated as many times as necessary in order to create all of the pools and/or subsets of tickets for a given game.

In accordance with various embodiments, the present invention provides a system including a set of physical game tickets for playing a first game, wherein each physical game ticket of the set of physical game tickets includes a substrate having first and second planar surfaces, wherein each of the first and second planar surfaces includes a top edge, a bottom edge, and at least one side edge, and wherein each physical game ticket has applied thereon a primary encrypted symbolization along the at least one side edge of the first planar surface of the ticket and a secondary encrypted symbolization along the top or bottom edge of the second planar surface of the ticket. The system further includes a first subset of the game tickets associated with a first number of potentially winnable prizes, with such subset of tickets forming a completed winning symbolization in the form of the combination of the primary encrypted symbolization and the secondary encrypted symbolization when the ticket is twisted, which aligns the primary encrypted symbolization from the at least one side edge of the first planar surface of the ticket with the secondary encrypted symbolization from the top or bottom edge of the second planar surface of the ticket. The system further includes a second subset of the game tickets forming a non-winning incompatible combination comprising the primary encrypted symbolization and the secondary encrypted symbolization when the ticket is physically twisted to align the primary encrypted symbolization from the at least one side edge of the first planar surface of the ticket with the secondary encrypted symbolization from the top or bottom edge of the second planar surface of the ticket.

The first game can be the sole game on the ticket, or can be one of multiple games on the ticket, including a bonus game, for example. Other games, such as an instant matching game, can be presented entirely on either the first or second planar surface of the ticket, as shown in FIGS. 1 through 3, for example.

In the above process, it will be appreciated that the remote server randomly generates the indicia and symbolization(s), including the encrypted (e.g., partially completed) symbolization(s). The user can be issued a ticket by having a physical ticket printed by or through use of the vending device 15. Alternatively, a virtual ticket can be displayed on such devices 15 and optionally printed thereafter as desired by the user. As a further alternative, pre-printed tickets can be provided for selection by a user at a retail establishment. Winnings can be awarded in a number of ways. For example, winnings can be awarded based on whether the primary encrypted symbolization and secondary encrypted symbolization form a completed and recognizable symbolization. It will be appreciated that various embodiments employ encrypted symbolizations such that first and second encrypted symbolizations form a word, and third and fourth encrypted symbolizations form a design, wherein creating either one or both of the complete word and/or complete design are required in order to win. As shown in FIGS. 1 through 3, first encrypted symbolization 29 is the left portion of the word "WIN", second encrypted symbolization is the right portion 33 of the word "WIN", third encrypted symbolization 27 is the left half of a design symbol, and fourth encrypted symbolization is the right half 37 of a design symbol. Further, a fifth encrypted symbolization 23 is the left half of the phrase "TWIST SYMBOL" and the sixth encrypted symbolization 39 is the right half of the phrase "TWIST SYMBOL".

It will be appreciated that all of the disclosed methods and procedures herein can be implemented using one or more computer programs or components. These components may be provided as a series of computer instructions on any conventional computer-readable medium, including non-transitory computer-readable media. RAM, SATA DOM or other storage media. The instructions may be configured to be executed by a processor which, when executing the series of computer instructions, performs or facilitates the performance of all or part of the disclosed methods and procedures. The present invention can be implemented using hardware, software, or a combination thereof, and can be implemented in one or more computer systems or other processing systems. In various embodiments, the invention is directed toward one or more computer systems capable of carrying out the functionality described herein.

Unless otherwise stated, devices or components of the present invention that are in communication with each other do not need to be in continuous communication with each other. Further, devices or components in communication with other devices or components can communicate directly or indirectly through one or more intermediate devices, components or other intermediaries. Further, descriptions of embodiments of the present invention herein wherein several devices and/or components are described as being in communication with one another does not imply that all such components are required, or that each of the disclosed components must communicate with every other component. In addition, while algorithms, process steps and/or method steps may be described in a sequential order, such approaches can be configured to work in different orders. In other words, any ordering of steps described herein does not, standing alone, dictate that the steps be performed in that order. The steps associated with methods and/or processes as described herein can be performed in any order practical. Additionally, some steps can be performed simultaneously or substantially simultaneously despite being described or implied as occurring non-simultaneously.

It will be appreciated that algorithms, method steps and process steps described herein can be implemented by appropriately programmed general purpose computers and computing devices, for example. In this regard, a processor (e.g., a microprocessor or controller device) receives instructions from a memory or like storage device that contains and/or stores the instructions, and the processor executes those instructions, thereby performing a process defined by those instructions. Further, programs that implement such methods and algorithms can be stored and transmitted using a variety of known media. At a minimum, the memory includes at least one set of instructions that is either permanently or temporarily stored. The processor executes the instructions that are stored in order to process data. The set of instructions can include various instructions that perform a particular task or tasks. Such a set of instructions for performing a particular task can be characterized as a program, software program, software, engine, module, component, mechanism, or tool. Common forms of computer-readable media that may be used in the performance of the present invention include, but are not limited to, RAM, USB drive or any other memory chip or cartridge, or any other medium from which a computer can read. The term "computer-readable medium" when used in the present disclosure can refer to any medium that participates in providing data (e.g., instructions) that may be read by a computer, a processor or a like device. Such a medium can exist in many forms, including, for example, non-volatile media, volatile media, and transmission media. Non-volatile media include, for example, USB and other persistent memory. Volatile media can include dynamic random access memory (DRAM), which typically constitutes the main memory. Transmission media may include coaxial cables, copper wire and fiber optics, including the wires or other pathways that comprise a system bus coupled to the processor. Transmission media may include or convey acoustic waves, light waves and electromagnetic emissions, such as those generated during radio frequency (RF) and infrared (IR) data communications.

Various forms of computer readable media may be involved in carrying sequences of instructions associated with the present invention to a processor. For example, sequences of instruction can be delivered from RAM to a processor, carried over a wireless transmission medium, and/or formatted according to numerous formats, standards or protocols, such as Transmission Control Protocol/Internet Protocol (TCP/IP), Wi-Fi, Bluetooth, GSM, CDMA, EDGE and EVDO. Where databases are described in the present disclosure, it will be appreciated that alternative database structures to those described, as well as other memory structures besides databases may be readily employed. The drawing figure representations and accompanying descriptions of any exemplary databases presented herein are illustrative and not restrictive arrangements for stored representations of data. Further, any exemplary entries of tables and parameter data represent example information only, and, despite any depiction of the databases as tables, other formats (including relational databases, object-based models and/or distributed databases) can be used to store, process and otherwise manipulate the data types described herein. Electronic storage can be local or remote storage, as will be understood to those skilled in the art. Appropriate encryption and other security methodologies can also be employed by the system of the present invention, as will be understood to one of ordinary skill in the art.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

The invention claimed is:

1. A system for use by lottery game players, the system comprising:

a set of physical game tickets for playing a first game, wherein each physical game ticket of the set of physical game tickets includes a substrate having first and second planar surfaces, wherein each of the first and second planar surfaces includes a top edge, a bottom edge, and at least one side edge, wherein each physical game ticket has applied thereon a primary encrypted symbolization along the at least one side edge of the first planar surface of the physical game ticket and a secondary encrypted symbolization along the top or bottom edge of the second planar surface of the physical game ticket;

a first subset of the set of physical game tickets forming a completed winning symbolization comprising the primary encrypted symbolization and the secondary encrypted symbolization when the physical game ticket is twisted to align the primary encrypted symbolization from the at least one side edge of the first planar surface of the physical game ticket with the secondary encrypted symbolization from the top or bottom edge of the second planar surface of the physical game ticket; and a second subset of the set of physical game tickets forming a non-winning incompatible combination comprising the primary encrypted symbolization and the secondary encrypted symbolization when the physical game ticket is physically twisted to align the primary encrypted symbolization from the at least one side edge of the first planar surface of the physical game ticket with the secondary encrypted symbolization from the top or bottom edge of the second planar surface of the physical game ticket.

2. The system of claim 1, further including a second game on each physical game ticket, wherein the second game is entirely on the first or second planar surface.

3. The system of claim 1, wherein the completed winning symbolization comprises a single, fully formed word, phrase or design.

4. The system of claim 1, wherein the completed winning symbolization comprises a pair of fully formed words, phrases or designs.

5. The system of claim 1, wherein the primary encrypted symbolization is oriented horizontally and the secondary encrypted symbolization is oriented vertically.

6. The system of claim 1, wherein the completed winning symbolization of the first subset of physical game tickets cannot be independently determined by the first or second planar surface.

7. A lottery ticket, comprising:

a substrate comprising first and second planar surfaces, wherein the substrate has applied thereon a primary encrypted symbolization on the first planar surface and a secondary encrypted symbolization on the second planar surface, wherein the primary encrypted symbolization is oriented horizontally and the secondary encrypted symbolization is oriented vertically; and a completed winning symbolization comprising the primary encrypted symbolization and the secondary encrypted symbolization when the substrate is physically twisted to align the primary encrypted symbolization from the first planar surface with the secondary encrypted symbolization from the second planar surface.

8. The lottery ticket product of claim 7, wherein the completed winning symbolization comprises a single, fully formed word, phrase or design.

9. The lottery ticket product of claim 7, wherein the completed winning symbolization comprises a pair of fully formed words, phrases or designs.

10. The lottery ticket product of claim 7, wherein the completed winning symbolization of the first number of potentially winnable prizes cannot be independently determined by the first or second planar surface.

11. A lottery ticket product having encrypted planar displays, comprising:

a substrate having first and second planar surfaces, wherein each of the first and second planar surfaces includes a top edge, a bottom edge, and at least one side edge, wherein the substrate includes, on the first planar surface, a primary game display comprising an instant win game, and a primary encrypted symbolization associated with a secondary game along the at least one side edge of the first planar surface;

wherein the substrate further includes a secondary encrypted symbolization associated with the secondary game, wherein the secondary encrypted symbolization is included along the top or bottom edge of the second planar surface; and wherein the substrate forms a completed winning symbolization for the secondary game comprising the primary encrypted symbolization and the secondary encrypted symbolization when the substrate is physically twisted to align the primary encrypted symbolization from the at least one side edge of the first planar surface with the secondary encrypted symbolization from the top or bottom edge of the second planar surface of the substrate.

12. The lottery ticket product of claim 11, wherein the winning status of the secondary game cannot be determined by one planar surface.

13. The lottery ticket product of claim 11, wherein the completed winning symbolization comprises a single, fully formed word, phrase or design.

14. The lottery ticket product of claim 11, wherein the completed winning symbolization comprises a pair of fully formed words, phrases or designs.

15. The lottery ticket product of claim 11, wherein the primary encrypted symbolization is oriented horizontally and the secondary encrypted symbolization is oriented vertically.

* * * * *